US007674068B2

(12) United States Patent
Valles

(10) Patent No.: US 7,674,068 B2
(45) Date of Patent: Mar. 9, 2010

(54) CEMENT HEATING AND FINISHING MACHINE

(76) Inventor: Cleto T. Valles, 900 W. Palmer Rd., Las Cruces, NM (US) 88005

( * ) Notice: Subject to any disclaimer, the term of this patent is extended or adjusted under 35 U.S.C. 154(b) by 0 days.

(21) Appl. No.: 12/224,218

(22) PCT Filed: Nov. 14, 2007

(86) PCT No.: PCT/US2007/023915

§ 371 (c)(1),
(2), (4) Date: Aug. 21, 2008

(87) PCT Pub. No.: WO2008/069901

PCT Pub. Date: Jun. 12, 2008

(65) Prior Publication Data

US 2009/0087264 A1 Apr. 2, 2009

(51) Int. Cl.
*E01C 23/14* (2006.01)
*E01C 19/22* (2006.01)

(52) U.S. Cl. ..... 404/95; 404/112

(58) Field of Classification Search ..... 404/112, 404/118, 95; 15/235.4
See application file for complete search history.

(56) References Cited

U.S. PATENT DOCUMENTS

| | | | | |
|---|---|---|---|---|
| 1,332,474 | A * | 3/1920 | Skelly | 126/201 |
| 2,882,805 | A | 4/1959 | Sieber | |
| 3,173,413 | A | 3/1965 | Denton | |
| 4,461,341 | A * | 7/1984 | Morrison | 165/51 |
| 4,557,626 | A * | 12/1985 | McKay et al. | 404/90 |
| 4,955,721 | A * | 9/1990 | Clark et al. | 366/24 |
| 5,188,481 | A * | 2/1993 | O'Brien | 404/95 |
| 6,422,786 | B1 * | 7/2002 | Grant | 404/112 |
| 6,957,869 | B1 | 10/2005 | Sawtelle | |
| 6,974,277 | B2 | 12/2005 | Lutz et al. | |
| 2006/0083589 | A1 * | 4/2006 | McClain | 404/112 |
| 2006/0196074 | A1 * | 9/2006 | Vilhunen | 34/79 |

FOREIGN PATENT DOCUMENTS

| | | |
|---|---|---|
| JP | 8-184173 | 7/1996 |
| JP | 10-88804 | 4/1998 |

* cited by examiner

*Primary Examiner*—Thomas B Will
*Assistant Examiner*—Abigail A Risic
(74) *Attorney, Agent, or Firm*—Richard C. Litman

(57) ABSTRACT

The cement finishing machine (10) has adjustable heat generating assemblies (22, 24), affixed to each side of the finishing machine (10). Each of the heat generating assemblies (22, 24) includes a propane burner that extends into an elongate heating tube. The heat generating assemblies (22, 24) also include a vertical adjustment assembly and detachable heat guards. The heat generated by the propane burner is directed through an opening in the bottom of each of the heating tubes and onto the surface of an unfinished cement slab during the cement finishing process. The heat facilitates the evaporation of excess water generated during the cement finishing process.

10 Claims, 4 Drawing Sheets

CEMENT HEATING AND FINISHING MACHINE

TECHNICAL FIELD

The present invention generally relates to cement finishing machines. More specifically, the present invention is drawn to a cement finishing machine with adjustable heaters that enhance the removal of excess water from the surface of a cement slab during the finishing process.

BACKGROUND ART

Conventional cement finishing machines employ rotating trowel blades to smooth the wet cement slab. Time is lost during the cement finishing process because excess water must be removed from the surface of the slab.

The related prior art includes multiple cement finishing machines that employ various means to heat the surface of a cement slab for one purpose or another. Pertinent examples of such machines are identified and cited in the accompanying information disclosure statement (IDS). However, none of the machines cited and identified in the related art includes adjustable heaters designed to remove excess water during the cement finishing process, as will subsequently be described and claimed in the instant invention.

The need exists for a cement finishing machine that would effectively enhance the removal of excess water from the cement slab during the finishing process. The cement finishing machine of the current invention improves the efficiency of the cement finishing process and advances the state of the art by providing a cement finishing machine that effectively removes excess water from the cement slab during the cement finishing process. In tested applications, cement slab finishing time was reduced by one-third when the heaters of the current invention were employed. The cement finishing machine of the current invention is inexpensive, dependable and fully effective in accomplishing the intended tasks.

DISCLOSURE OF INVENTION

The disclosure is directed to a cement finishing machine. The machine includes a drive mechanism mounted on a structural frame. A multi-blade trowel blade assembly is connected to the drive mechanism. An outer blade guard ring is connected to the frame so that the outer blade guard ring encircles the trowel blade assembly. At least one heat generating assembly is mounted on the outer blade guard ring. In operation, the heat generating assembly generates heat and directs the heat to an unfinished concrete slab. The heat facilitates the evaporation of excess water produced during the operation of the trowel blade assembly during the cement finishing process.

The disclosure is also directed to a system for removing excess water from a cement slab during a cement finishing process. The system includes a cement finishing machine and at least one propane-powered heat generating assembly mounted on the cement finishing machine. During a cement finishing process the propane-powered heat generating assembly generates heat and directs the heat to an unfinished concrete slab to facilitate the evaporation of excess water produced during a cement finishing process.

The disclosure is further directed to a method of finishing an unfinished cement slab. A cement finishing machine is provided and at least one heat generating assembly is connected to the cement finishing machine. Once the cement finishing process is initiated, heat is directed from the heat generating assembly onto an unfinished cement slab. The heat facilitates the evaporation of excess water produced during the cement finishing process.

The disclosure is also directed to a method of making a cement finishing machine. The cement finishing machine is manufactured by producing the frame of the cement finishing machine. A drive mechanism is mounted on the frame and linked to a multi-blade trowel assembly. An outer blade guard ring is also attached to the frame so that the outer blade guard encircles the trowel blade assembly. At least one heat generating assembly is mounted on the outer blade guard so that the heat generating assembly generates heat and directs the heat to an unfinished concrete slab. The heat facilitates the evaporation of excess water produced during the operation of the trowel blade assembly during a cement finishing process.

BRIEF DESCRIPTION OF THE DRAWINGS

Similar reference characters denote corresponding features consistently throughout the attached drawings.

BEST MODES FOR CARRYING OUT THE INVENTION

Figure 1:
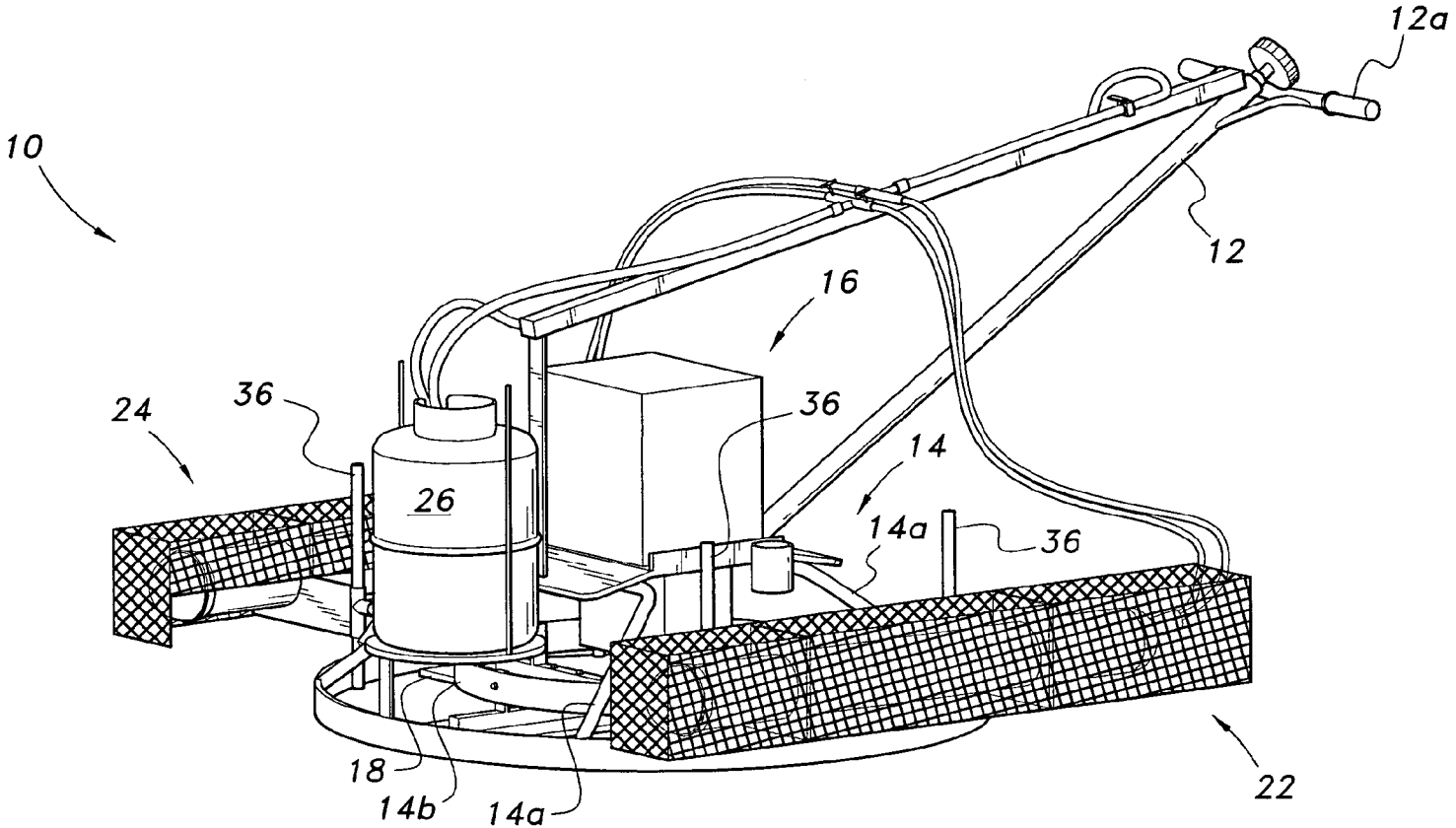
FIG. 1 is an environmental, perspective view of a cement finishing machine according to the present invention.

The present invention is drawn to a cement finishing machine 10 that has adjustable heat generating assemblies 22, 24 affixed to each side of the finishing machine 10, as shown generally in FIG. 1.

The cement finishing machine of the current invention 10 comprises a handle 12 having a first end terminating in a handgrip control 12*a*. The second end of handle 12 is mounted to a frame generally indicated at 14. Frame 14 comprises an array of tubular members 14*a* designed to support a drive mechanism 16. The drive mechanism 16 rotates a trowel blade assembly 18 beneath an inner support ring 14*b*. The trowel blade assembly 18 comprises multiple trowel blades and is best shown in FIG. 3.

Figure 2:
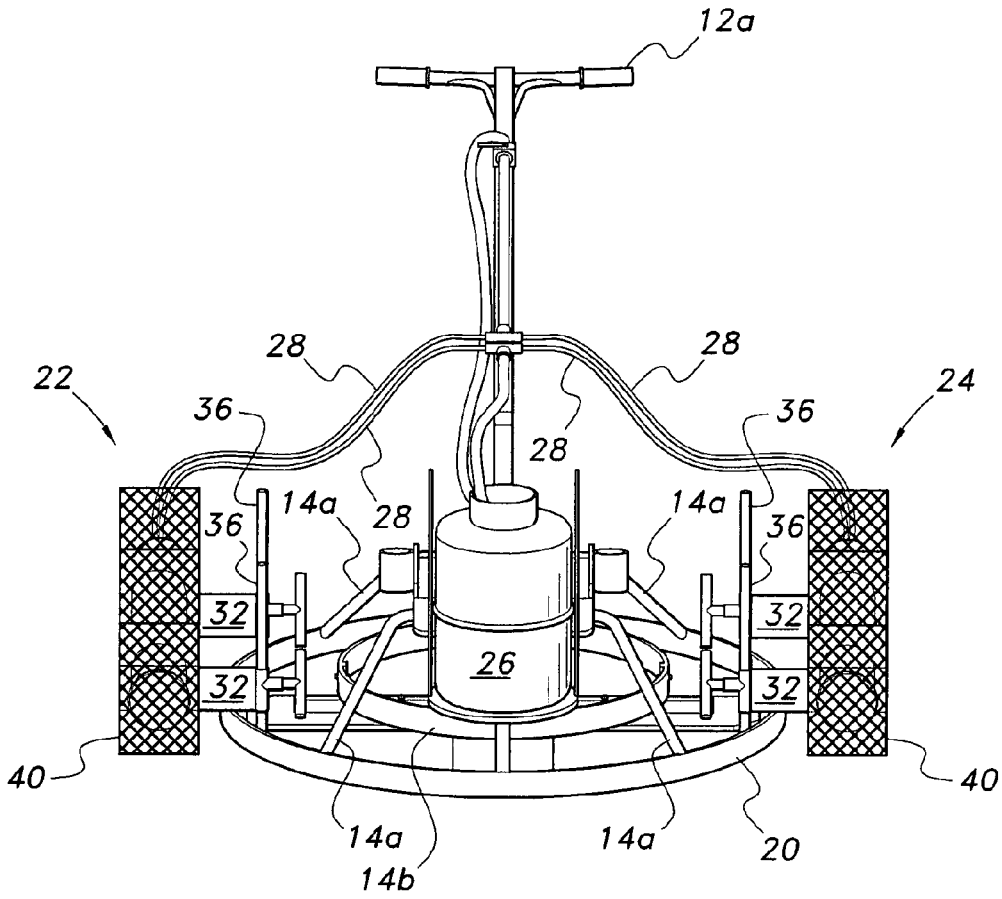
FIG. 2 is a perspective, rear view of a cement finishing machine according to the present invention.
Figure 3:
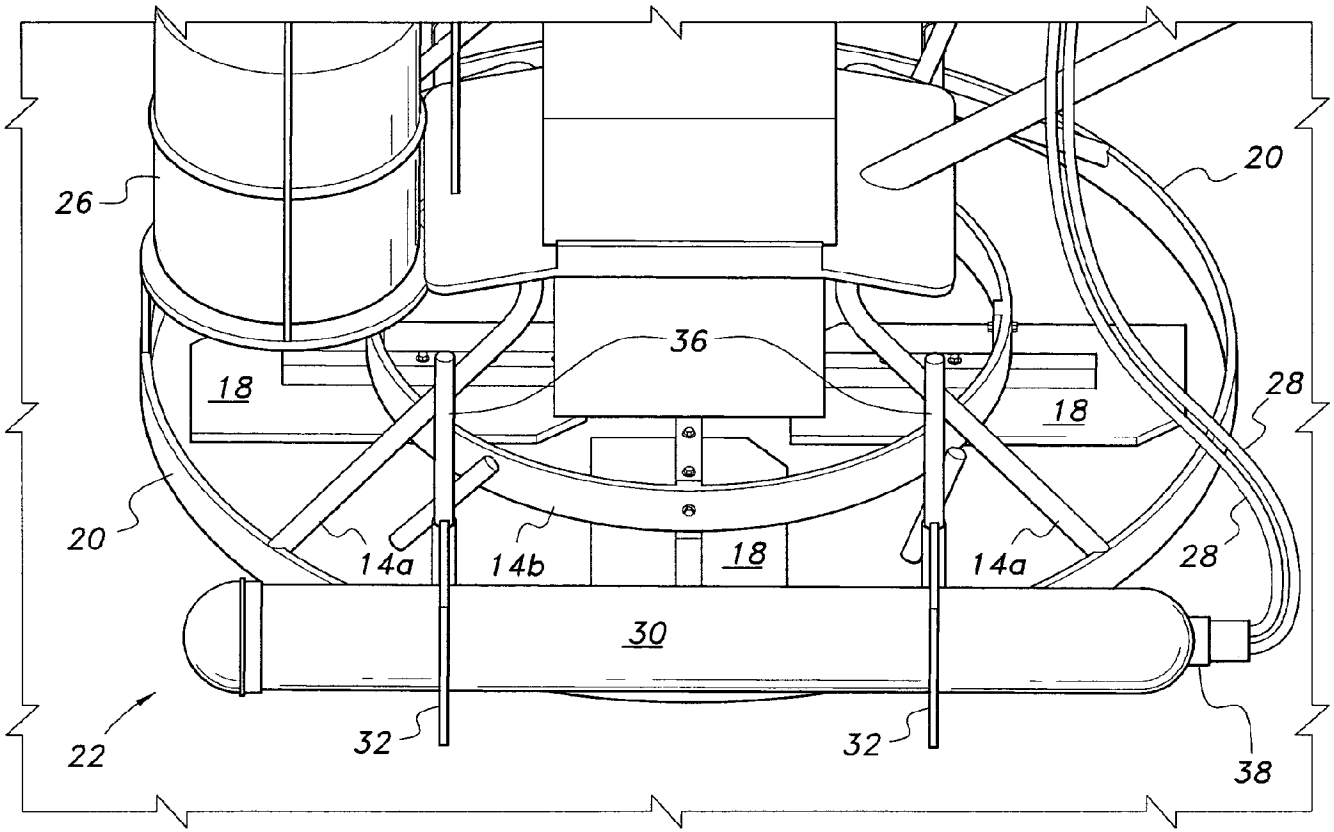
FIG. 3 is a perspective, lateral view of the cement finishing machine (with the heat generating assembly heat guard removed) according to the present invention.

As best shown in FIGS. 2 and 3, an outer support ring 20 is attached to tubular members 14*a* and is disposed outwardly of and concentrically with the inner support ring 14*b*. The heat generating assemblies 22, 24 are adjustably supported by the outer support ring 20 via support brackets 32 and rods 36. The heat generating assemblies 22, 24 also include heating tubes 30 and detachable heat guards 40. The detachable heat guards 40 at least partially enclose the heating tubes 30. The heat guards 40 are comprised of expanded metal and may have a general mesh design.

FIG. 3 shows an exemplary view of the heating assembly 22 in the installed position with the detachable heat guard 40 removed. The installed position of heating assembly 24 is essentially a mirror image of the configuration shown in FIG. 3. Consequently FIG. 3 should also be considered to disclose the installed position of heating assembly 24.

Figure 4:
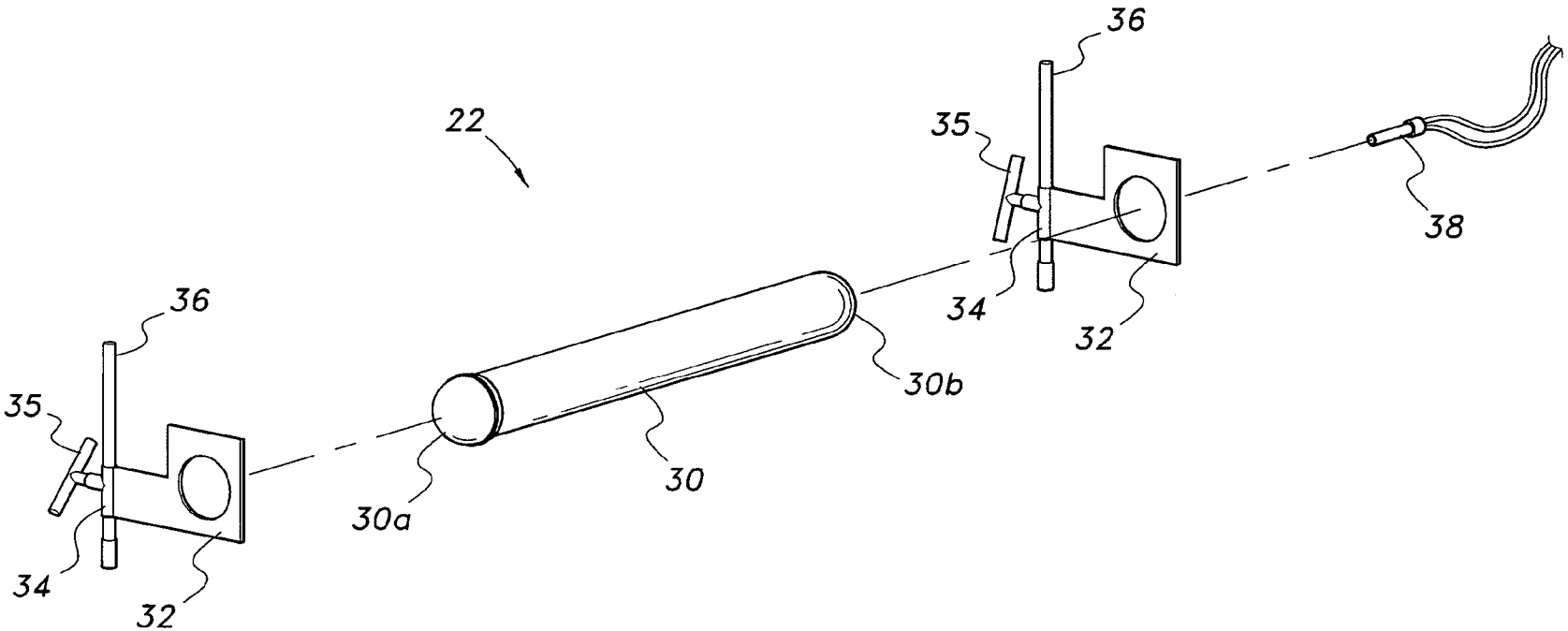
FIG. 4 is an exploded view of the heating tube and burner arrangement in a cement finishing machine according to the present invention.

As best shown in FIGS. 3 and 4, in the preferred embodiment, the heating tubes 30 are powered by propane gas burners which may include a pilot light mechanism as well as all valves and associated components required to ensure safe operation. The heating tubes 30 include an elongate opening (not shown) on the downwardly facing underside of tubes 30 so that the heat generated within the tubes 30 is directed downwardly toward the cement slab. During the cement finishing process, the heat generated by the heating tubes 30 acts to facilitate the evaporation of excess water produced during the finishing process. The heating assemblies 22, 24 are operated separately so that one or both heating assemblies 22, 24 may be employed at any given time.

Although FIG. 4 shows a nozzle-type propane burner 38, the specific configuration of the propane burner(s) 38 may include any configuration known in the art that effectively generates heat that may be directed from the heating tubes 30 toward the cement slab. This includes an elongate mandrel-type burner which may extend long the length of the heating tube 30. Although the preferred embodiment employs a propane heat source, other heat sources should be considered within the scope of the invention, including heat generated by electricity, diesel, kerosene, natural gas, gasoline and other fuels/heat sources.

As best shown in FIGS. 3 and 4, the heating tube 30 is fashioned with a closed distal end 30*a* and an open proximal end 30*b*. In the preferred embodiment, the nozzle of the propane gas burner 38 is positioned in the open proximal end 30*b* of the heating tube 30. Propane gas is supplied to the burners 38 from a tank 26 (best shown in FIGS. 1 and 2) that is supported by the inner 14*b* and outer 20 support rings. The propane gas is supplied to the burners 38 via gas lines 28. As indicated above, the burner 38 may also include a pilot light mechanism to facilitate easy activation of the burner 38.

As best shown in FIGS. 3 and 4, in the preferred embodiment, the support brackets 32 are attached to the heating tubes 30 at points along the length of the heating tube 30. In alternative embodiments the heating tubes may be supported in by other means known in the art. As best shown in FIG. 4, the brackets 32 are provided with sleeves 34 at one end thereof. The sleeves 34 are adapted for vertical movement on the rods 36 so that the brackets 32 and the associated heating tubes 30 are vertically moveable.

As best shown in FIG. 4, to adjust the height of the heating assemblies 22, 24, a user loosens the tensioning screw mechanism 35, and slides the brackets 32 vertically along the rods 36. When the brackets 32 and associated tube 30 are at the required height, the user then re-tightens the tensioning screw mechanism 35 to hold the heating assemblies 22, 24 at the desired height. No tools are required to adjust the height of the heat generating assemblies 22, 24. In the preferred embodiment, the position of the heat generating assemblies 22, 24 can be vertically adjusted to a height of between two and ten inches, or alternatively to any height specified by a user.

Based on the foregoing disclosure, the current invention clearly provides a concrete finishing machine that improves the efficiency of the cement finishing process by effectively removing excess water from a cement slab during the cement finishing process. The cement finishing machine of the current invention has a relatively simple and robust design, is inexpensive, dependable, and fully effective in improving the efficiency of the cement finishing process.

It is to be understood that the present invention is not limited to the embodiment described above, but encompasses any and all embodiments within the scope of the following claims.

The invention claimed is:

1. A cement finishing machine, comprising:

a frame;

a drive mechanism mounted on said frame;

a trowel blade assembly connected to said drive mechanism, said trowel blade assembly comprising a plurality of trowel blades;

an outer support ring connected to said frame, said outer support ring encircling said trowel blade assembly; and at least one heat generating elongated tube mounted on said outer support ring, wherein the mounting includes at least one vertical rod secured to said outer support ring and at least one bracket adjustably mounted thereon for vertical movement, said bracket defining a support for the elongated tube; and wherein said at least one heat generating tube generates heat and directs the heat to an unfinished concrete slab to facilitate evaporation of excess water produced during operation of said trowel blade assembly during a cement finishing process.

2. The cement finishing machine according to claim 1, wherein said at least one heat generating tube is vertically adjustable between two and ten inches.

3. The cement finishing machine according to claim 1, wherein said heat generating tube comprises a propane burner.

4. The cement finishing machine according to claim 3, wherein said heating tube has an open proximal end and a closed distal end so that a nozzle of said propane burner extends into said open proximal end.

5. The cement finishing machine according to claim 4, wherein said heating tube has a downwardly facing opening so that heat generated from said propane burner is directed through said downwardly facing opening and onto said cement slab.

6. The cement finishing machine according to claim 5, wherein said heating tube is at least partially enclosed by a heat guard.

7. The cement finishing machine according to claim 6, wherein said heat guard is comprised of expanded metal and has a mesh design.

8. The cement finishing machine according to claim 1, wherein said cement finishing machine comprises two parallel heat generating tubes mounted diametrically opposed to each other on said outer support ring.

9. The cement finishing machine according to claim 8, wherein each of said heat generating tubes comprises a propane burner, one propane burner being attached to each of said parallel tubes respectively.

10. The cement finishing machine according to claim 9, wherein both of said propane burners is powered by a single propane tank positioned between said parallel tubes.

* * * * *